US010670369B1

(12) United States Patent
Ding et al.

(10) Patent No.: US 10,670,369 B1
(45) Date of Patent: Jun. 2, 2020

(54) HANDGUARD ASSEMBLY AND RELATED METHOD

(71) Applicant: Leapers, Inc., Livonia, MI (US)

(72) Inventors: Tai-lai Ding, Northville, MI (US); Tat Shing Yu, Plymouth, MI (US); Zhuhao Jin, New Hudson, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 16/514,471

(22) Filed: Jul. 17, 2019

(51) Int. Cl.
*F41C 23/16* (2006.01)
*F41A 3/66* (2006.01)
*F41A 21/48* (2006.01)

(52) U.S. Cl.
CPC ..... *F41C 23/16* (2013.01); *F41A 3/66* (2013.01); *F41A 21/485* (2013.01)

(58) Field of Classification Search
CPC ..... F41C 23/16
USPC ..... 42/71.01–74
See application file for complete search history.

(56) References Cited

U.S. PATENT DOCUMENTS 5,328,312 A * 7/1994 Driscoll ..... B64G 1/641 403/11
5,802,755 A * 9/1998 Tortorici ..... F41A 13/08 403/105
8,297,169 B2 * 10/2012 Kunda ..... F16B 5/025 411/108
2011/0061281 A1 * 3/2011 Kapusta ..... F41C 23/16 42/71.01
2014/0026459 A1 * 1/2014 Yan ..... F41C 23/16 42/71.01
2017/0209277 A1 * 7/2017 Leszko ..... A61F 2/3859
2018/0172396 A1 * 6/2018 Kincel ..... F41C 23/16
2018/0202757 A1 7/2018 Samson et al.
2018/0202758 A1 7/2018 Samson et al.
2018/0202759 A1 7/2018 Samson et al.
2019/0170476 A1 * 6/2019 Hiler, Jr. ..... F41A 21/482
2019/0323541 A1 * 10/2019 Windfeldt ..... F16B 21/02

* cited by examiner

*Primary Examiner* — Bret Hayes
(74) *Attorney, Agent, or Firm* — Warner Norcross + Judd, LLP

(57) ABSTRACT

A handguard assembly and related method are provided. The handguard assembly can include a fastener assembly that installs in a handguard bore of a handguard. The fastener assembly can include a fastener head including first threads threaded in a first direction, a shaft extending from the fastener head, the shaft including second threads threaded in a second direction opposite the first direction, and a lock tab threadably engaging the second threads, the lock tab including a tab head. When the fastener assembly is converted from a retracted mode to an extended mode, the tab head can wedge into a barrel nut groove to secure the handguard to the barrel nut thereby impairing the handguard from rotating and/or sliding relative to the barrel nut. The shaft can thread into the lock tab when the fastener assembly is installed relative to the groove, with the overall length of the fastener assembly increasing as the tab head moves in the groove.

20 Claims, 8 Drawing Sheets

HANDGUARD ASSEMBLY AND RELATED METHOD

BACKGROUND OF THE INVENTION

The present invention relates to firearms, and more particularly to a handguard assembly that secures a handguard to a firearm.

Many modern sporting and military firearms include a handguard that extends forward and around a barrel of the firearm. The handguard prevents contact between the user and the barrel, thereby protecting the user when the barrel heats up after extended periods of fire. The handguard also can provide one or more rails or other surfaces upon which to mount accessories, such as lights, lasers, grenade launchers and other items.

An issue with many handguards is that they can be difficult to securely and precisely mount to a firearm. Frequently, handguards are provided with screws that tighten against a part of the barrel or some other portion of the firearm. While the screws can hold the handguard in most situations, they can sometimes give way and slide, so that the handguard can rotate, under excessive forces or moments exerted on the handguard, relative to the remainder of the firearm. In turn, this can provide an inadequate grasping surface. In other cases, where the rotation is significant, rails on the handguard can misalign with other rails on the remainder of the firearm. This can be particularly problematic where a sight or laser is mounted on the handguard. As a result of the rotation or misalignment, the firearm can become less accurate or the accessory can be damaged.

Accordingly, there remains room for improvement in the field of handguards, and in particular, the way that they are secured to a firearm to prevent rotation or movement of the handguard, and any associated accessories, relative to the remainder of the firearm.

SUMMARY OF THE INVENTION

A handguard assembly and related method of use are provided. The handguard assembly can include a fastener assembly that installs in a threaded bore of a handguard and includes differently threaded portions that enable a tab lock of the fastener assembly to advance toward and wedge into a barrel nut groove, thereby selectively securing the handguard to a barrel nut.

In one embodiment, the fastener assembly can include a fastener head including first threads threaded in a first direction, a shaft extending from the head where the shaft includes second threads threaded in a second direction opposite the first direction, and a lock tab threadably engaging the second threads.

In another embodiment, the fastener assembly can be operable in a retracted mode in which it does not engage a barrel nut groove of the barrel nut, and an extended mode. When the fastener assembly is converted from the retracted mode to the extended mode, the tab head can wedge into the barrel nut groove to secure the handguard to the barrel nut thereby impairing the handguard from rotating and/or sliding relative to the barrel nut.

In still another embodiment, the lock tab can include a tab head. The shaft can thread into the lock tab when the fastener assembly is installed relative to the groove, with the overall length of the fastener assembly increasing as the tab head moves into the groove.

In yet another embodiment, the lock tab can include a threaded portion and an unthreaded cavity closer to the tab head. The second threads on the shaft can thread to the threaded portion. When the fastener head is advanced in the threaded handguard bore, the threaded head can move toward the barrel nut. The shaft can rotate relative to the threaded portion such that the tab head moves away from the fastener head simultaneously as the fastener head threads toward the barrel nut. Optionally, an overall length of the fastener assembly can increase as the fastener assembly advances toward the barrel nut.

In still yet another embodiment, the lock tab can include a concave upper surface configured to engage an annular groove extending around the barrel nut at a particular location in the groove. The concavity of the upper surface can be such that the tab is curved around the longitudinal axis of the barrel nut. The upper surface can include tapered portions so that the tab head can wedge into the groove.

In still even another embodiment, the handguard can include an interior. The interior can define a tab groove coextensive with the threaded handguard bore. The tab head groove can be elongated, and can extend at least partially around a longitudinal axis of the handguard. The tab head of the lock tab can fit within the tab groove before the fastener assembly is converted from the retracted mode to the extended mode. This interfitment can enable the tab head to clear the barrel nut before the tab head is extended into the barrel nut groove in the extended mode.

In yet another embodiment, the handguard interior includes an innermost surface, with the tab groove forming a recess in the innermost surface. That innermost surface can be closer to the longitudinal axis than a bottom of the tab head groove. The tab head can include laterally extending wings that fit within the recess so that the tab head is nonrotatable relative to the recess and thus the handguard, when the fastener assembly is in the retracted mode as well as the extended mode.

In still another embodiment, the overall length of the fastener assembly can increase as the fastener head is threaded into the threaded handguard bore, with the fastener head and shaft advancing toward the longitudinal axis of the barrel nut. The overall length of the fastener assembly can increase simultaneously as the fastener head advances in the threaded handguard bore.

In even another embodiment, a method of installing the handguard assembly is provided. The method can include: installing the fastener assembly in the threaded handguard bore of the handguard where the fastener assembly includes the fastener head threaded in a first direction and the shaft threaded in a second direction opposite the first direction, and a lock tab threadably engaging second threads on the shaft.

In a further embodiment, the method can include disposing the handguard about a barrel nut to at least partially conceal the barrel nut, aligning the lock tab with a barrel nut groove defined by the barrel nut, and rotating the fastener assembly so that the lock tab extends toward a longitudinal axis of the handguard, and wedges into the barrel nut groove to restrain the handguard in a fixed position along the longitudinal axis and about the longitudinal axis.

In still a further embodiment, the method can include rotating the fastener assembly so that the second threads thread out of a tab lock threaded portion such that an overall length of the fastener assembly increases as the tab head engages a barrel nut groove defined by a barrel nut.

In yet another embodiment, the fastener assembly can be installed relative to the handguard from an interior of the handguard. The fastener head can be threaded into the first threads of the threaded handguard bore. As the fastener head is rotated, the fastener head moves away from the longitudinal axis of the handguard toward an exterior of the handguard. The tab head moves with the fastener head, but does not unscrew relative to the shaft, such that the tab head follows the fastener head toward the exterior of the handguard until the fastener assembly is in the retracted mode.

In a further embodiment, the tab head can be disposed in a tab groove on the interior of the handguard, such that the tab lock cannot rotate relative to the handguard, or relative to the threaded handguard bore. The fastener head and shaft, however, can continue to rotate, while the tab head remains nonrotating relative to the handguard.

The current embodiments of the handguard assembly and related method of the provide benefits in mounting a handguard to a weapon that previously have been unachievable. For example, where the fastener assembly is preinstalled in the handguard, the fastener assembly and handguard can be quickly and efficiently installed relative to a barrel nut. The fastener assembly can be quickly converted from the retracted mode to the extended mode so that the tab head engages the barrel nut groove to secure the handguard to the barrel nut and thus the handguard to the weapon. The fastener assembly can be quickly loosened to convert the fastener assembly from the extended mode to the retracted mode so that the handguard can be removed easily from the barrel nut, without the fastener assembly becoming disassociated from the handguard. This construction can provide exceptional locking of the handguard to the weapon, which adds significant rigidity to the weapon via the interaction of the handguard and the barrel nut. The handguard can be firmly and securely mounted to the receiver.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
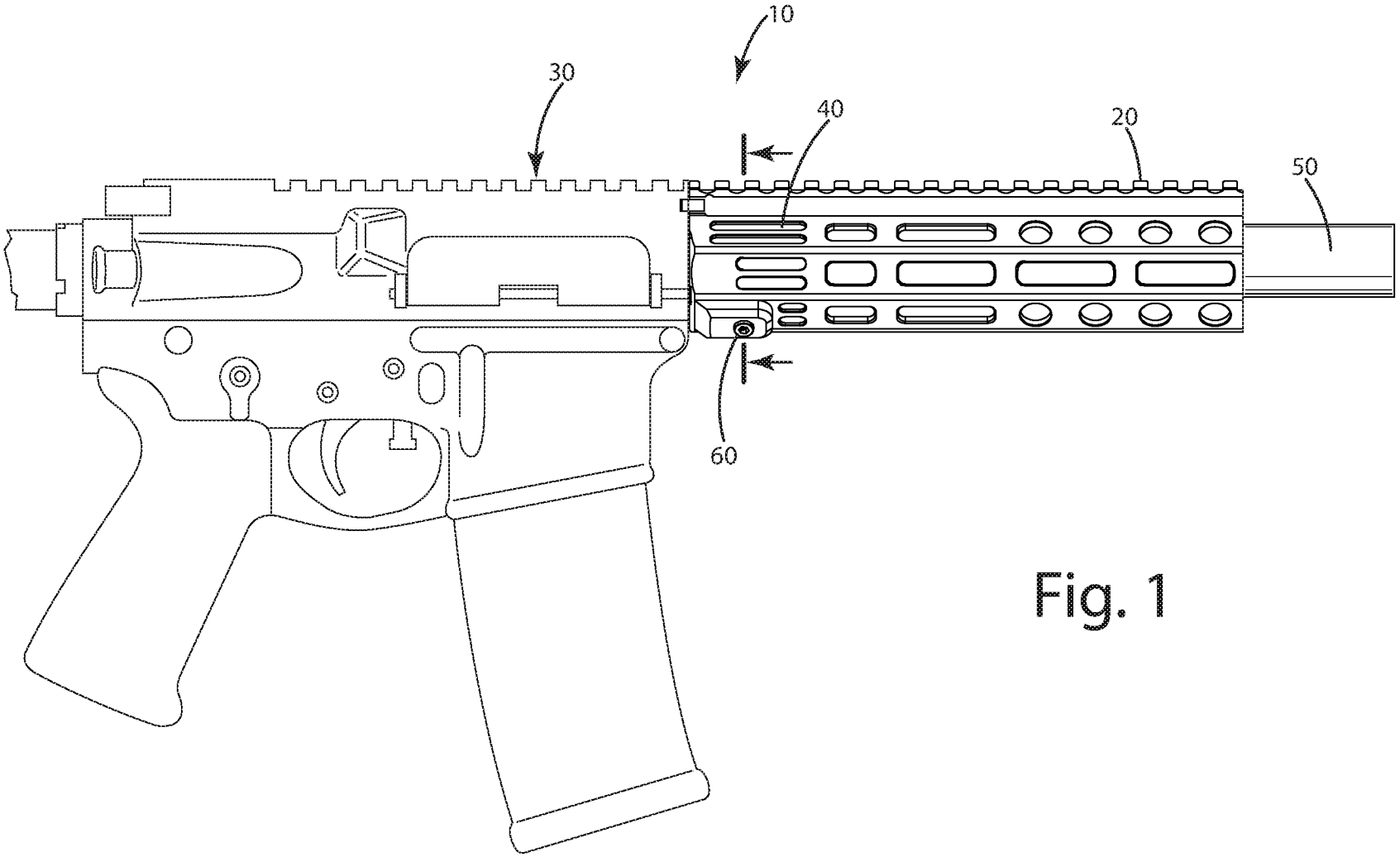
FIG. 1 is a side view of the handguard assembly of a current embodiment, shown mounted on a weapon over a barrel.

A current embodiment of the handguard assembly is illustrated in FIGS. 1-11 and generally designated 10. The handguard assembly 10 is configured to secure a handguard 20 to a receiver 30 associated with a weapon, such as a firearm. The weapon can be a sporting, military or hunting rifle, for example an AR15, an AK47, variants thereof and other firearm systems that include a barrel and a handguard. The handguard assembly 10 can include a barrel nut 40 that is threaded onto a base 32 of the receiver 30 to secure a barrel 50 to the receiver 30. The barrel nut 40 can include a barrel nut groove 43 defined about a portion of the barrel nut 40. A fastener assembly 60 can be threaded into a handguard bore 20B which itself can be threaded. The fastener assembly 60 can include a fastener head 63 including first threads 61, and a shaft 64 including second threads 62, along with a lock tab 70. The first threads 61 can be threaded in a first direction, for example, they can be right hand threads, while the second threads 62 can be threaded in a second direction, for example, they can be left hand threads. Optionally, the respective threading can be reversed, with the first threads left handed and the second threads right handed. When the fastener head 63 is threaded into the handguard bore 20B, the lock tab 70 effectively threads off from the shaft such that the overall length of the fastener assembly 60 increases as the fastener head advances toward the barrel nut. Eventually, the lock tab 70, and in particular, the tab head 73 can engage and/or wedge into the barrel nut groove 43. Because the fastener assembly 60 is secured in the bore of the handguard 20, the handguard 20 is effectively secured and mounted in a fixed rotational and longitudinal orientation relative to the barrel nut and thus the weapon.

Turning now to FIGS. 1-6, the handguard assembly and components of the weapon will now be described in further detail. The handguard 20 mounts over the barrel 50 of the firearm. The barrel 50 can include a muzzle end 51 and a receiver end 52. The receiver end 52 can be configured to be inserted in the base 32, and the barrel nut 40 can be threaded on the base to secure the receiver end 52 to the receiver 30. The handguard 20 can be an elongated tube like member. The handguard can be placed over the barrel 50 and generally over the barrel nut 40, optionally concealing the barrel nut. The handguard 20 can include a rear edge 21 and a front edge 22 that is distal from the rear edge 21. The rear edge 21 can engage the receiver 30 when the handguard is installed. The portion of the handguard near the rear edge 21 generally can be referred to as the receiver end of the handguard. The portion of the handguard or the front edge 22 can generally be referred to as the muzzle end of the handguard.

Figure 3:
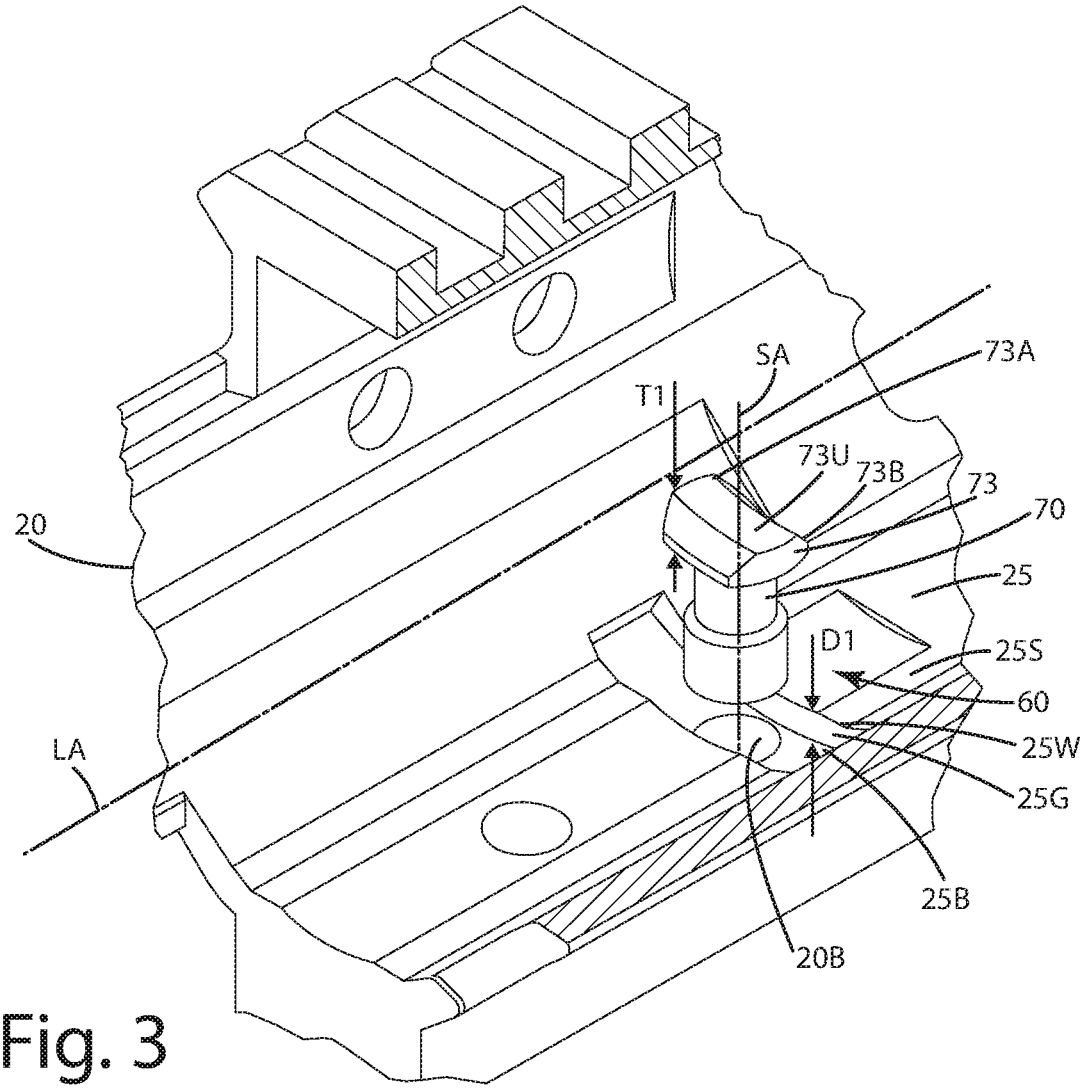
FIG. 3 is a perspective view of a fastener assembly of the handguard assembly being installed relative to a portion of a handguard.
Figure 5:
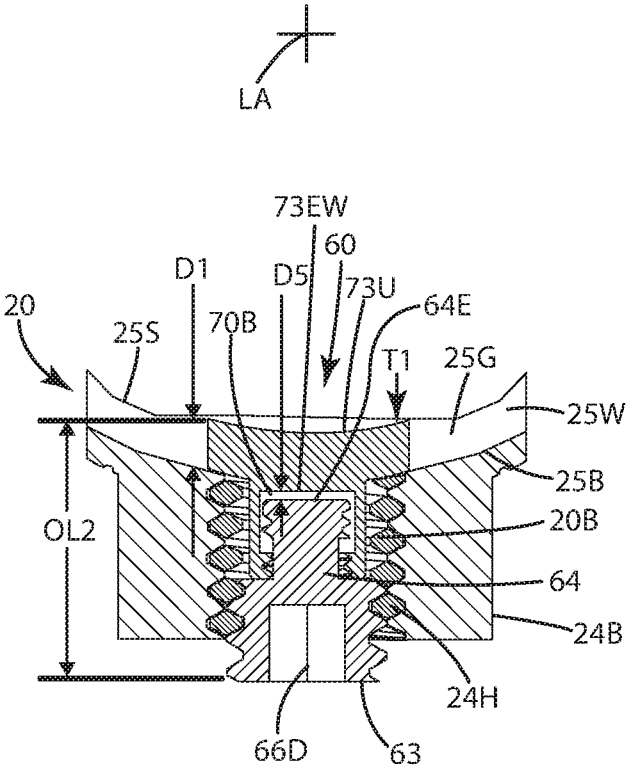
FIG. 5 is a partial section view of the fastener assembly side fully installed in the threaded bore of the handguard before the handguard is assembled to the barrel nut, taken along line 4-4 in FIG. 1.
Figure 6:
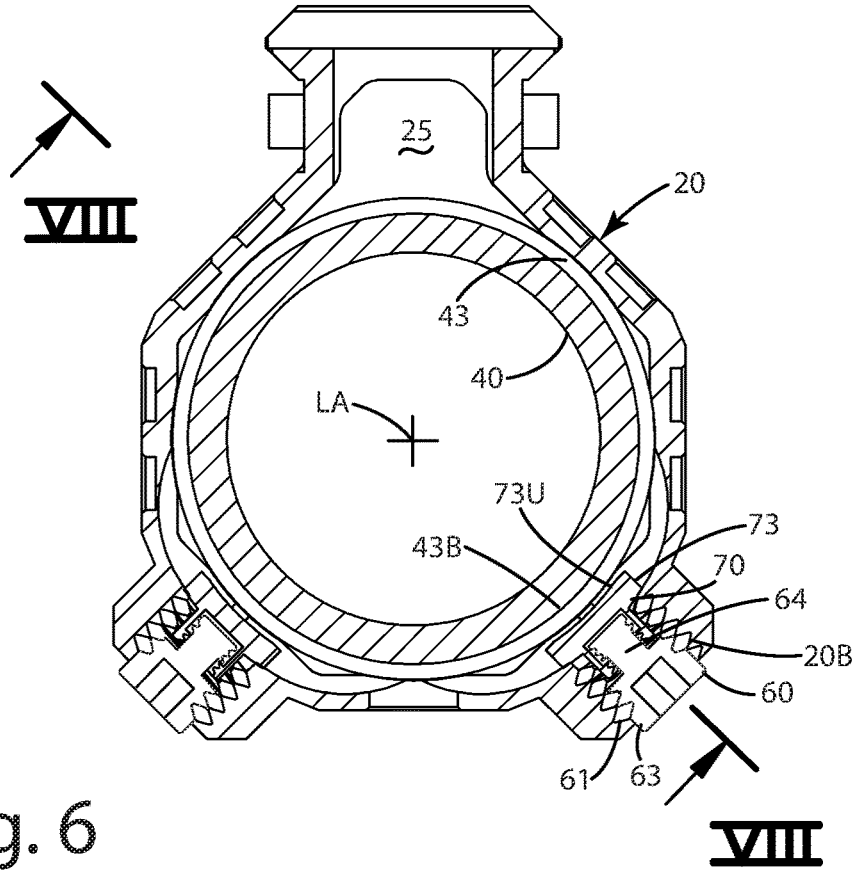
FIG. 6 is a section view of the handguard assembly fastener assemblies installed in the handguard in a retracted mode before the fastener assemblies secure the handguard to the barrel nut taken along line 6-6 in FIG. 1.
Figure 7:
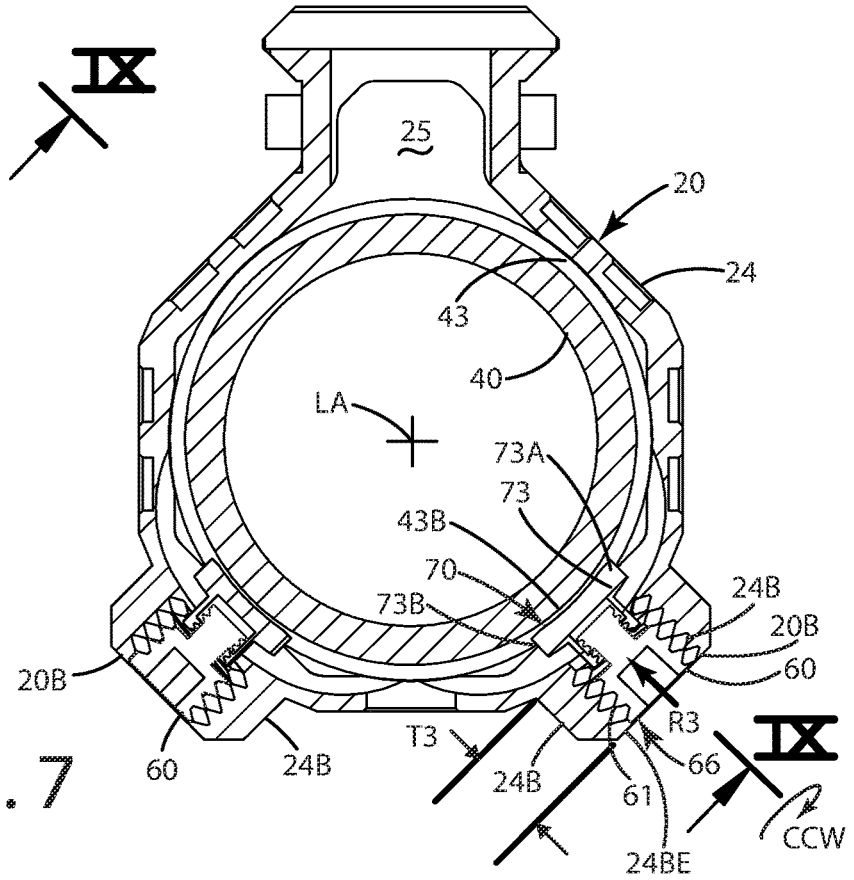
FIG. 7 is a section view of the handguard assembly with fastener assemblies installed in the handguard in an extended mode so that the fastener assemblies secure the handguard to the barrel nut taken along line 6-6 in FIG. 1.

The handguard shown in FIGS. 3-7 can include a handguard exterior 24 and a handguard interior 25. The handguard exterior 24 can include multiple surfaces, which optionally can form a contoured exterior surface for gripping by a user. As shown, that exterior surface can be a generally octagonal shape. A picatinny rail 24P can be disposed on a top portion of the handguard exterior 24. Along a lower surface of the handguard exterior 24, one or more thread blocks 24B can form part of the handguard. Where these blocks are located, the handguard can be greater in thickness than remaining portions of the handguard in other regions of the handguard. The handguard can define one or more handguard bores 24B, which optionally can be defined in the thread block. The handguard bore can be located at the receiver end, near the rear edge of the handguard. These bores can be in a variety of configurations. For example, as shown in FIG. 7, the multiple bores can be disposed on opposite lower portions of the handguard generally around the longitudinal axis. In contrast, as shown in FIG. 3, the bores can be aligned one in front of the other and aligned with a longitudinal axis LA of the handguard. As shown, the handguard can define two handguard bores to accommodate two fastener assemblies 60. Of course, the handguard assembly can include a single handguard bore or additional handguard bores to accommodate one or more fastener assemblies, depending on the application.

As shown in FIG. 7, the handguard bore 20B can be threaded through the thickness T3 of the handguard and the thread block in particular. The handguard bore 20B can extend from an exterior 24BE of the block to an interior 24BI of the block and/or the handguard. In this construction, the handguard bore 20B can extend through a thickness of the handguard that is greater than other portions of the handguard having other, lesser thicknesses. This can provide additional rigidity and support to the fastener assembly when installed in the threaded bore, and can prevent stripping of the respective bore threads. The threaded bore can be aligned so that it projects generally toward the interior 25 of the handguard and optionally generally radially toward the longitudinal axis LA of the handguard.

Figure 12:
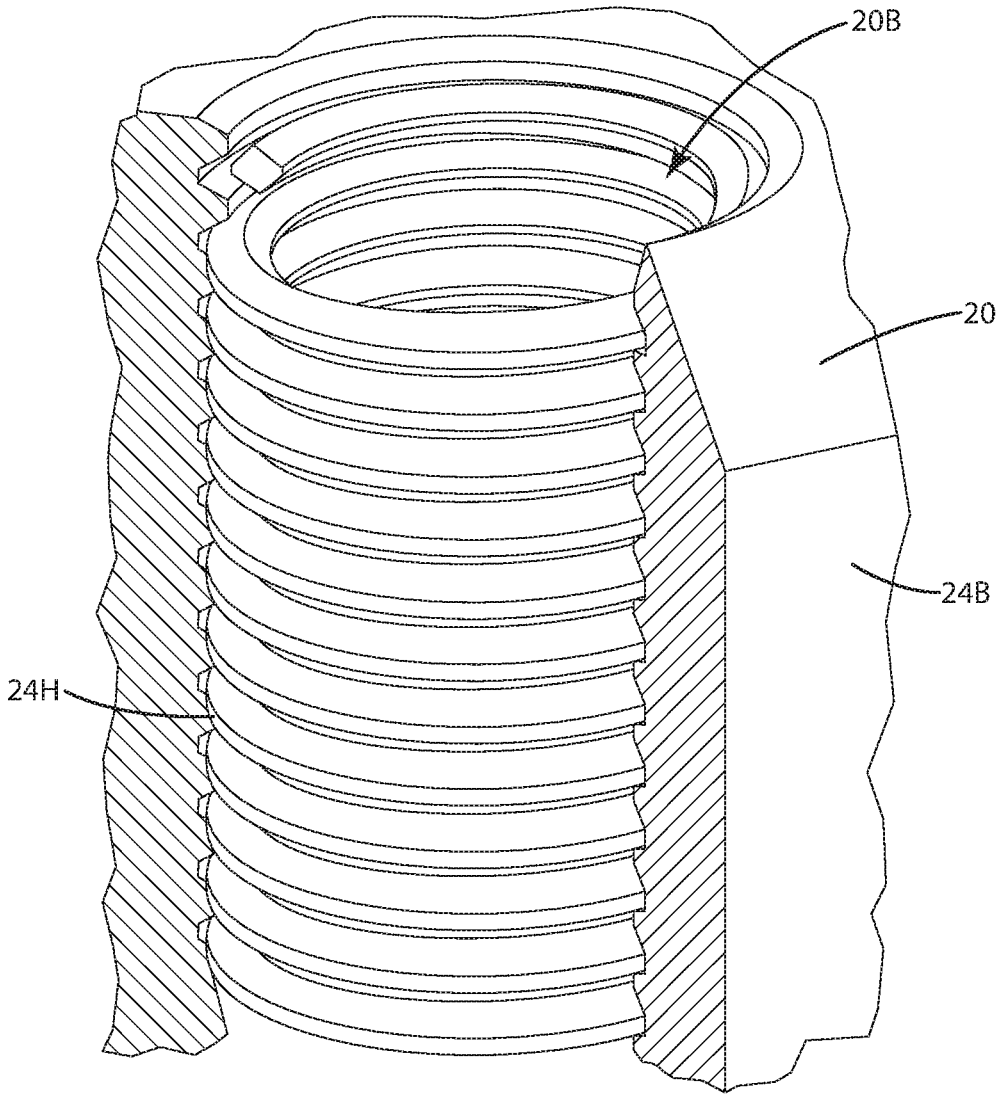
FIG. 12 is a partial section view of a helicoil that can be used with the fastener assembly.

Optionally, the threaded portion of the bore 20B can be lined with a helicoil 24H as is shown in FIG. 12. This helicoil can be constructed from a harder, more durable and wear resistant material than the remainder of the handguard 20 so that the threads can withstand multiple interactions with the threaded fastener assembly. For example, the helicoil can be constructed from steel, while the remainder of the handguard can be constructed from aluminum. As used herein, a handguard bore or threaded bore may or may not include a helicoil disposed therein, or between different components.

Figure 4:
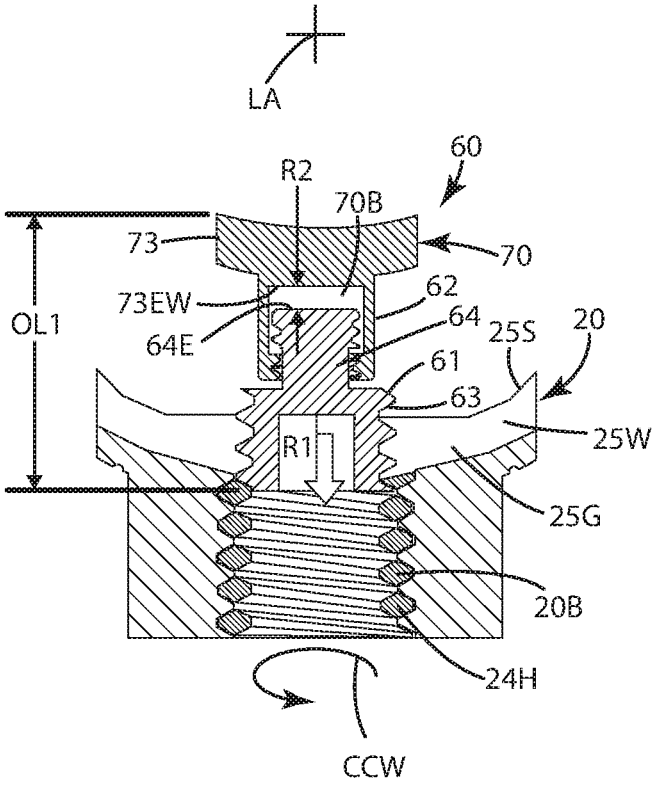
FIG. 4 is a partial section view of the fastener assembly being initially installed in a threaded bore of the handguard before the handguard is assembled to a barrel nut, taken along line 4-4 in FIG. 1.

As shown in FIGS. 3-5, the handguard 20 can be constructed so that the handguard interior 25 can include an interior surface 25S. The interior surface 25S can be in a location where a fastener assembly 60 is located. This interior surface 25S can define a tab groove 25G. This tab groove 25G can be bounded by a perimeter wall 25W and a bottom wall 25B. The tab groove or recess can be in communication with and can transition to the threaded bore 20B. This tab groove or recess 25G can be configured to receive a portion of a tab head 73 of the lock tab 70. In particular, the tab groove 25G can be constructed so that the tab head 73, in particular wings 73A and 73B thereof, can fit within that tab groove 25G. The tab groove 25G optionally can be of a depth D1 that is equal to or greater than a thickness T1 of the wings and the tab head 73 in general. When the fastener assembly 60 is in the retracted mode as described below, the concave upper surface 73U of the tab head 73 can be disposed below the interior surface 25S of the handguard 20 so that the tab head does not interfere with sliding or movement of the handguard over the barrel nut. The tab groove 25G thus can provide enough clearance of the tab head, and fastener assembly general, to install the handguard over the barrel nut.

Figure 2:
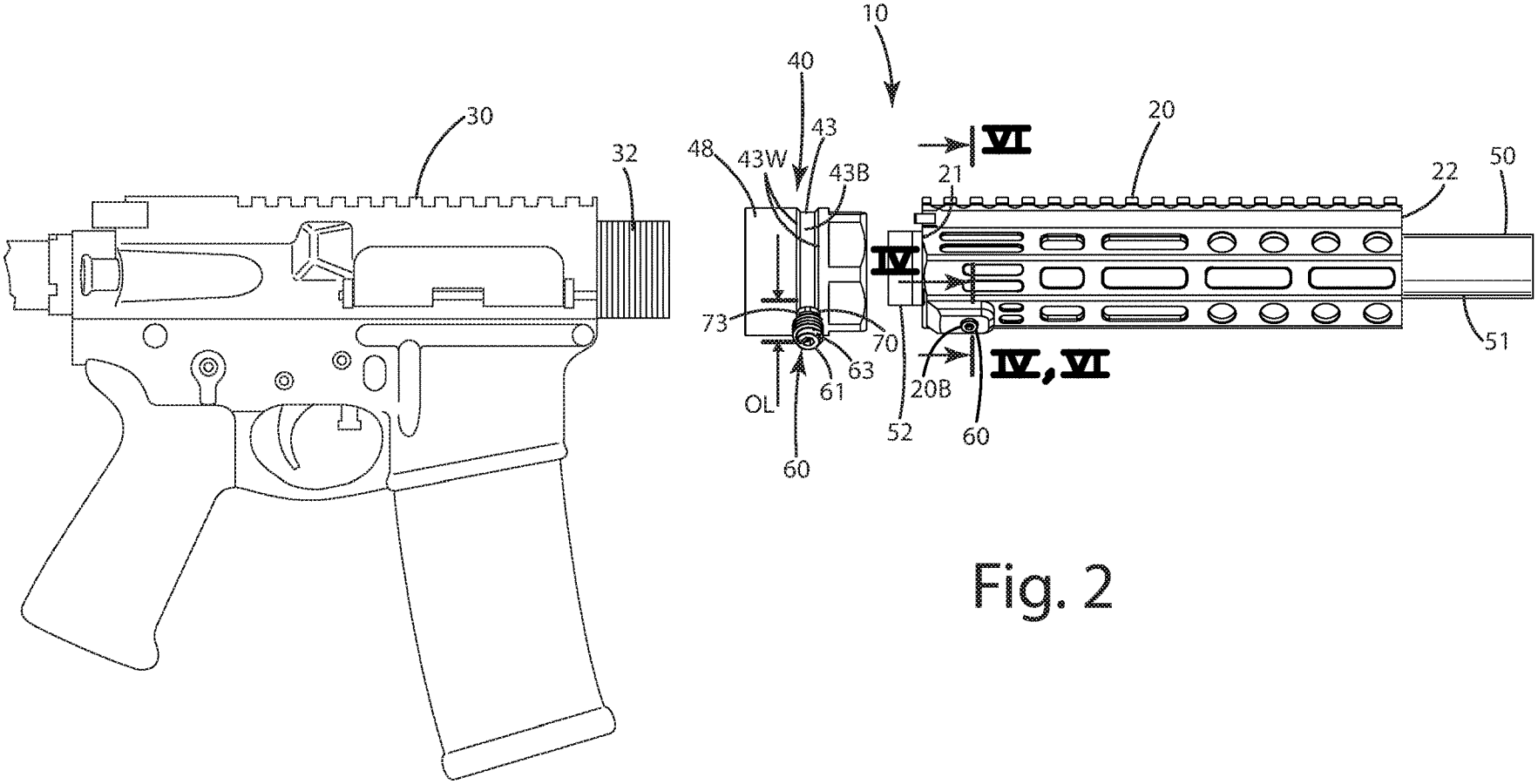
FIG. 2 is an exploded view of the handguard assembly on a weapon.
Figure 8:
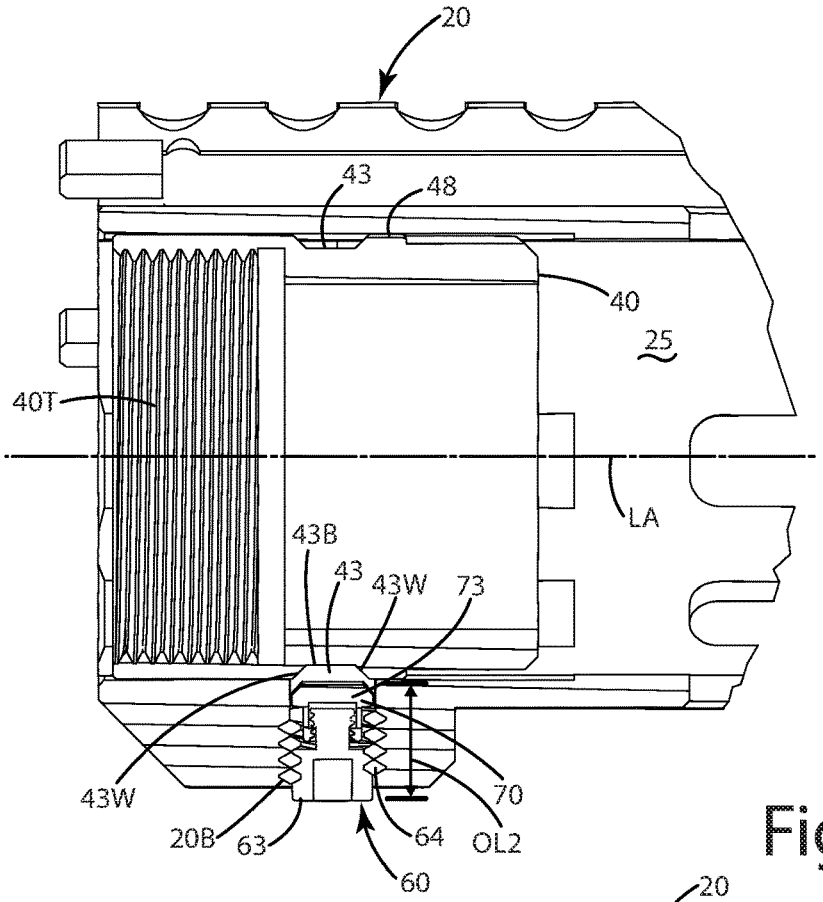
FIG. 8 is a section view of the handguard assembly with fastener assemblies installed in the handguard in the retracted mode before the fastener assemblies secure the handguard to the barrel nut taken along line 8-8 in FIG. 1.

As mentioned above, the handguard assembly 10 can include and/or be joined with the barrel nut 40. With reference to FIGS. 2 and 8, the barrel nut 40 can define a threaded internal bore 40T, which is configured to threadably engage the threaded portion of the base 32 and secure the barrel nut 40 and the barrel 50 to the receiver 30. The barrel nut 40 can include an exterior surface 48. The exterior surface 48 can be substantially cylindrical, however, other geometric shapes can be substituted therefor. For example, the exterior surface 48 can be of an octagonal, hexagonal, elliptical or some other shape depending on the application and the configuration of the handguard 20. The barrel nut 40 can include contours and/or other surfaces that can engage a portion of a tool, which can be used to rotate the barrel nut 40 about the longitudinal axis LA and thereby tighten the barrel nut onto the base toward the receiver.

As shown in FIGS. 2, 7 and 8, the barrel nut 40 can define one or more barrel nut grooves 43. A barrel nut groove 40 can be figured to be engaged by one or more fastener assemblies 60 as described below. In some constructions, there might be a single barrel nut groove that is engaged by 1, 2, 3 or more fastener assemblies. In other constructions, there might be 2, 3 or more barrel nut grooves that can be engaged by multiple individual fastener assemblies in different locations along the longitudinal axis of the barrel nut and/or handguard. These constructions can vary depending on the configuration of the barrel nut and/or the handguard.

The barrel nut groove 43 can extend all the way around the outer exterior surface of the nut, generally circumferentiating the barrel nut. In some cases, however, the barrel nut groove can be interrupted by a series of regularly or irregularly placed portions of the exterior surface so that the groove is broken into segments. As shown, the barrel nut groove 43 is continuous around the longitudinal axis LA of the barrel nut 40. The barrel nut groove 43 can be of a concave shape. As shown, this concave shape can include a bottom wall 43B and opposing side walls 43W. These opposing side walls 43W can be angled relative to the bottom wall 43B. These angles can be selected such that the tab head 73 and its similarly angled surfaces 73W1 and 73W2 can be wedged into the barrel nut groove 43. For example, the angled surfaces 73W1 and 73W2 of the tab head 73 can engage the respective walls 43W when the fastener assemblies are in the extended mode as described below.

Although the barrel nut groove is shown to include an angled, multifaceted configuration, the groove can be of other geometric configurations. For example, when taking a cross-section of a groove, instead of it being angular and comprising multiple surfaces, the groove can be semicircular or partially circular, partially elliptical, rounded, or some other angled and/or rounded cross section. The barrel nut groove can be shaped so that when the fastener assembly 60 is extended, the lock tab can engage and/or wedge into the barrel nut groove to tightly and firmly secure the handguard to the barrel nut and thus prevented the handguard from rotating about and/or sliding or otherwise moving along or relative to the longitudinal axis LA.

As mentioned above, the handguard assembly 10 can include one or more fastener assemblies 60. A fastener assembly 60 generally is configured to be installed in the handguard bore 20B defined by the handguard. The fastener assembly 60 can include a fastener assembly axis, which is coincident with a shaft axis SA of a shaft 64 of the assembly. The fastener assembly axis SA can project toward the interior 25 of the handguard 20, generally toward the longitudinal axis LA of the handguard and/or barrel nut. The fastener assembly 60 can include a fastener 66 and a lock tab 70. The fastener 66 can include a fastener head 63 and a shaft 64 projecting from the fastener head 66. The shaft can have a smaller diameter that the fastener head. The fastener head 66 can define a drive feature 66D with which a tool can be interfaced to allow the fastener to be rotated and/or moved relative to the handguard bore 20B. The fastener head 63 can include a plurality of first threads 61. These first threads 61 can be defined on an exterior of the fastener head. The first threads be threaded in a first direction. The first threads can threadably engage corresponding bore threads inside the handguard bore 20B. As an example, the first threads can be threaded as right-hand threads such that when the fastener head 63 is rotated in a clockwise movement, the right-hand threads advance the fastener head into the handguard bore, generally toward the longitudinal axis or the handguard interior.

The shaft 64 of the fastener 66 of the fastener assembly 60, can include a plurality of second threads 62. The second threads can be threaded in a second direction that is opposite the first direction of the first threads. The second threads 62 can threadably engage in corresponding threads 72 defined by the lock tab 70 as described below. As an example, the second threads can be threaded as left-hand threads such that as the fastener head and thus the shaft are rotated in a clockwise direction, the tab head 70 moves away from the fastener head 63, even as the fastener head 63 moves toward a longitudinal axis or interior of the handguard or barrel nut. As a further example, the second threads can be configured to interact with the threads 72 defined by a barrel 77 and a lower shoulder 73S of the tab head 73 such that as the fastener 66 is rotated in the clockwise direction, the end 64E of the shaft 64 moves away from an engagement wall 73EW of the head 73 disposed within a tab bore 70B described below. The shaft 64 mentioned above can include the second threads 62 disposed optionally near the shaft end 64E which is distal from the fastener head 63 of the fastener 66. The shaft also can include an unthreaded portion 64U between the second threads 62 and a fastener head surface or shoulder 63S. This unthreaded portion can be void of any threads between the first threads and the second threads.

Figure 10:
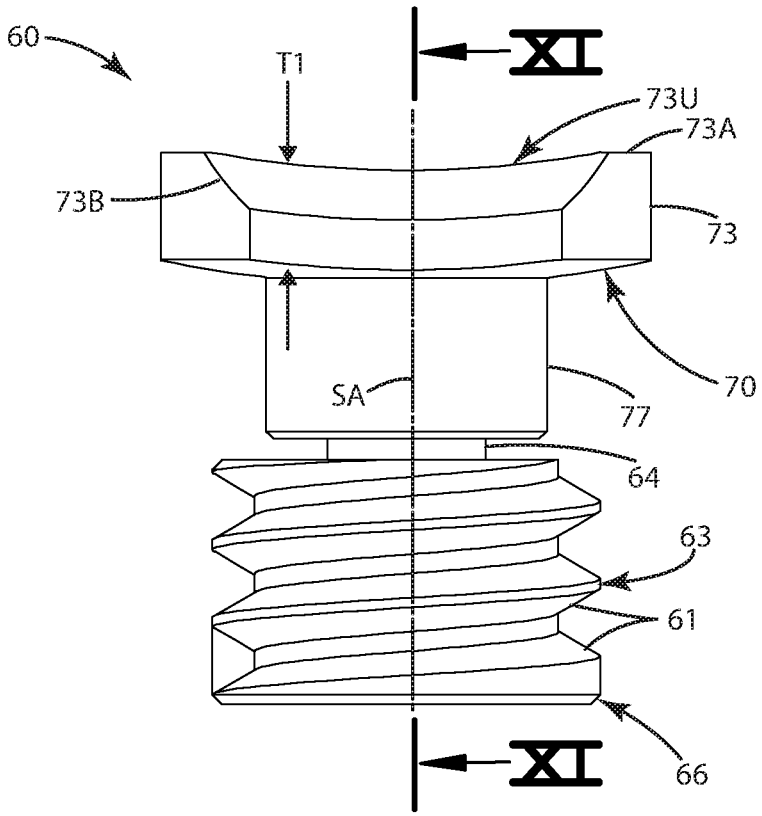
FIG. 10 is a section view of a fastener assembly.
Figure 11:
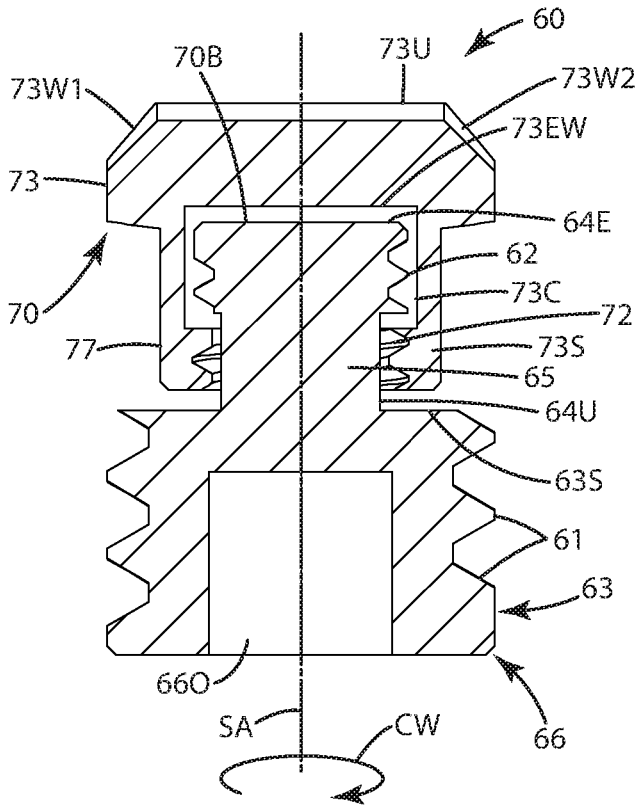
FIG. 11 is a section view of the fastener assembly taken along lines 11-11 of FIG. 10.

With reference to FIGS. 3, 10 and 11, the fastener assembly 60 can include the lock tab 70 including the tab head 73. The tab head 73 can include first and second wings 73A and 73B. As described above, these are configured to engage the tab groove 25B of the handguard 20 to optionally prevent rotation of the lock tab relative to the handguard. The tab head 73 also can include the optional angled surfaces 73W1 and 73W2 to engage and wedge into the barrel nut groove as described above. These first and second tapered surfaces 73W1 and 73W2 can be angled relative to one another and/or the uppermost extent or upper surface 73U of the tab head 73, and configured to wedge the tab head into the barrel nut groove of the barrel nut inside the handguard interior. Optionally, the tab head upper surface 73U can be slightly concave and/or contoured, but of course in some applications can be flat or multifaceted. The upper surface 73U can conform to the arcuate or curved surface surfaces of the barrel nut groove 43 that extend around the longitudinal axis LA. In general, the lock tab can threadably engage the second threads 62 of the fastener assembly 60.

As shown in FIG. 11, the lock tab 70 can define a tab bore 70B. The tab bore can include a threaded tab portion, which can correspond to a shoulder 73S of the tab lock. This threaded portion can include the threads 72 that are configured to engage the second threads 62 of the shaft 64. The tab bore 70B can include an unthreaded cavity portion 73C closer to the tab head 73 and/or the engagement wall 73EW than the shoulder or threaded portion 73S and thus the second threads 62 of the fastener 66 and/or shaft 64. Optionally, the tab bore 70B can be defined in a tab barrel 77 which extends from the tab head 73 generally away from the upper surface 73U of the tab head 73. The tab barrel 77 can define the tab bore 70B within which the shaft 64 is rotatably disposed. The tab barrel 77 also can include the lower shoulder or threaded portion 73S of the lock tab. The tab barrel 77 also can be of a diameter that is less than a diameter of the handguard bore 20B such that the barrel itself does not thread into or engage the threads of the handguard bore 20B. As described below, rotation of the fastener head 63 in a first rotation direction, for example clockwise, generally moves the lower shoulder 73S away from the fastener head 66, in a particular, away from the shoulder 63S of that fastener head 63, for example, when the fastener assembly 60 is converting from a retracted mode to an extended mode as described below.

A method of installing the handguard assembly 10 on a weapon will now be described. To begin, this method can be used to install a handguard on a firearm having an barrel and a receiver. Where a barrel nut 40 is installed relative to the receiver 30 and over the barrel, the user can join the handguard assembly 10, which can include the barrel nut, to the weapon. In particular, the barrel receiver end 52 can be placed in the base 32. The barrel nut 40 can be moved over the barrel 50, generally in a direction away from the muzzle end 51 toward the receiver end 52. The barrel nut 40 can be placed such that the threaded internal bore 40T engages the threads of the base 32. The barrel nut 40 can be rotated to further thread the barrel nut 40 onto the base 32 toward the receiver 30 and thereby secure the barrel 50 to the receiver. The barrel nut 40 optionally can be engaged by a tool to assist in the rotation about the longitudinal axis LA to thread the barrel nut onto the base. The threading continues until the barrel nut is tightened to a particular torque, depending on the particular application and construction of the receiver.

With the barrel nut 40 in place, the handguard 20 can be disposed over the barrel and over the barrel nut. For example, the handguard can be placed so that the rear end 21 travels over the muzzle 51 and the barrel 50 toward the receiver end 52. The handguard 20 also can be positioned such that the rear edge of the handguard engages the receiver 30. The handguard can be disposed generally about the barrel nut to at least partially conceal the barrel nut for example as shown in FIGS. 1 and 8.

In some applications, the fastener assembly 60 can be installed relative to the handguard before the handguard 20 is placed over the barrel nut 40 of the handguard assembly 10. For example, the fastener assembly 60 can be preinstalled in the handguard bore 20B of the handguard 20. With further reference to FIGS. 3, 4 and 5, this can be accomplished by threading the threaded fastener head 63 of the fastener 66 into the threaded handguard bore 20B. The fastener assembly 60 can initially be installed in through the interior 25 of the handguard 20. As shown in FIG. 4, the fastener head 63 can be rotated in a counterclockwise direction. Due to its first threads being right hand threads, the fastener head 63 threads outward, through the block of the handguard, through the handguard bore and generally away from the longitudinal axis LA. This rotation can be accomplished via a tool that extends through the bore 20B and engages the fastener head drive feature 66D of the fastener head 63.

As the fastener head 63 is rotated counter clockwise, the fastener assembly 60 moves in direction R1, away from the longitudinal axis, generally toward the exterior of the handguard. Due to the opposite threading of the second threads 62 on the fastener shaft 64, the fastener shaft 64 moves farther into the tab bore 70B. As the fastener head 63 moves in direction R1, the tab head 73 and the fastener head 63 simultaneously move toward one another in direction R2. This is because the opposite second threads 62 thread the shaft 64 into the bore 74B. This can be more evident comparing FIG. 4 with FIG. 5. As shown in FIG. 4, the end of the shaft 64E is a first distance D4 from the engagement wall 73EW. As shown in FIG. 5, the end of the shaft 64E is a second distance D5 from the engagement wall 73 EW. The second distance D5 is less than the first distance D4 because the shaft threaded into the bore 70B as the fastener head 63 was threaded out of the handguard bore 20B.

As shown in FIG. 5, the fastener assembly 60 can be installed in the handguard bore 20B. The fastener head 63, in particular the first threads 61, engage the threads of the bore 20B. The lock tab, in particular, the tab head 73, moves deeper into the tab groove 25G as shown in FIGS. 3 and 5. Upon installation of the fastener assembly, the bore 20B, the upper surface 73U of the tab head 73 can be recessed below the inner surface 25S of the handguard in some applications. The fastener assembly 60 can be advanced until the wings 73A, 73B engage the bottom 25B of the tab groove 25G. At this point, the advancement of the fastener head 63 can cease.

During the installation of the fastener assembly in the handguard bore and tab groove, the overall length of the fastener assembly 60 can be decreased from OL1 to OL2 as shown in comparing FIGS. 4 and 5. When the length is decreased, the shaft end 64E can engage the engagement wall 73EW. Of course, in other applications, this engagement might not occur. When the fastener assembly 60 is installed in the handguard bore, for example, as shown in FIGS. 5, 6 and 8, the fastener assembly 60 is effectively in a retracted mode and is not configured to engage the barrel nut or its barrel nut groove 40.

With the fastener assembly preinstalled relative to the handguard, the handguard can be installed over the barrel nut. As noted above, the lock tab can be within the tab groove or otherwise out of the way so that it can clear the barrel nut so the handguard 20 can be fully installed relative to the barrel nut.

After the handguard 20 is installed over the barrel nut, the handguard assembly can be generally free to rotate slightly about the barrel nut and/or slide along the longitudinal axis LA relative to the barrel nut toward and away from the receiver. The user can precisely place the handguard 20 relative to the receiver to provide alignment. Of course, the handguard and receiver can be outfitted with registration features to assist in this alignment and/or prevent rotation of the handguard relative to the barrel nut.

After the handguard 20 is properly positioned over the barrel nut 40, the fastener assembly 60 can be aligned with one or more barrel nut grooves 43 defined by the barrel nut 40. In this configuration, the barrel nut is disposed in the interior 25 of the handguard. As shown in FIGS. 6 and 8, the fastener assembly 60 is in the retracted mode. In this mode, the lock tab 70 and in particular, the tab head 73, is not engaging and does not protrude into the barrel nut groove 43 or otherwise engage the barrel nut 40. Again, in this configuration, the handguard 20 can still move relative to the barrel nut.

The fastener assembly 60 can be actuated to convert the fastener assembly 60 from a retracted mode to an extended mode to thereby secure the handguard 22 the barrel nut, and further assist and/or impair rotation of the handguard about the longitudinal axis and/or along the longitudinal axis, or generally movement of the handguard relative to the barrel nut. To convert from the retracted mode shown in FIGS. 6 and 8, in which the tab head 73 is generally out of the barrel nut groove, to the extended mode shown in FIGS. 7 and 9, where the lock tab and tab head are disposed in the barrel groove 43, a user can rotate the fastener head 63 in a first direction, for example in a clockwise direction, optionally with the use of a tool that engages the drive feature 66D of the fastener 66. Optionally, where the first and second threads are reversed, for example, with a first threads 61 being left hand threads and the second threads 62 being right hand threads, the user can alternatively rotate the fastener head 63 in opposite direction, such as a counterclockwise direction.

Figure 9:
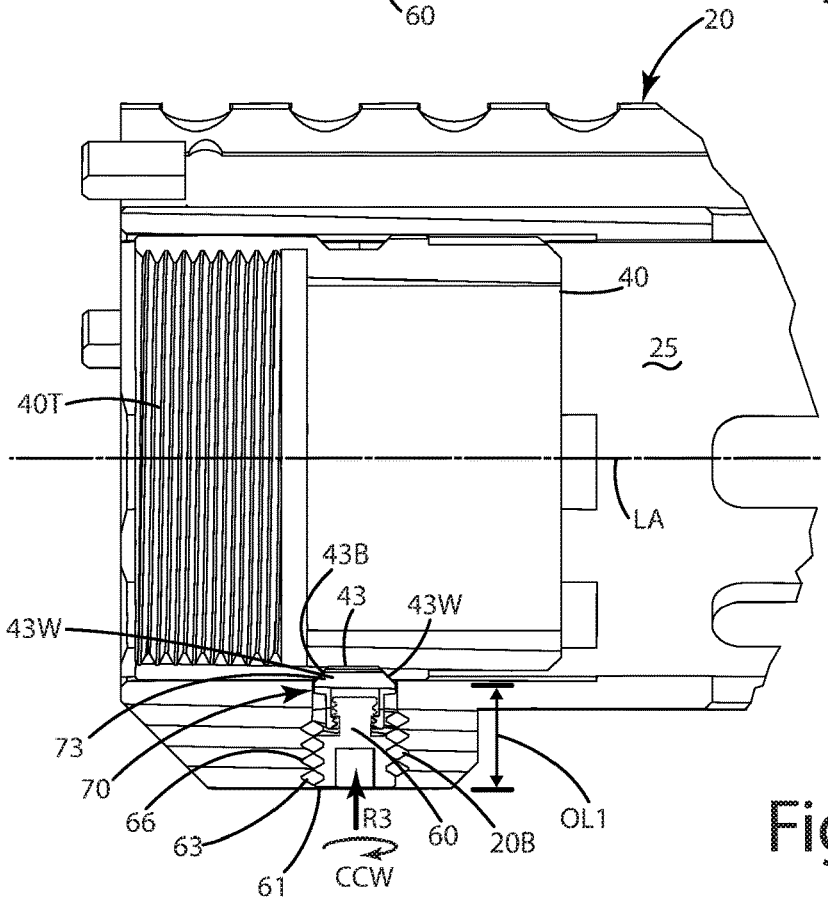
FIG. 9 is a section view of the handguard assembly with fastener assemblies installed in the handguard in an extended with the fastener assemblies securing the handguard to the barrel nut taken along line 8-8 in FIG. 1.

Returning to the current embodiment shown in FIGS. 7 and 9, the fastener head 63 can be rotated in the clockwise direction CW. As the head 63 is rotated, the first threads 61 engage the corresponding threads in the handguard bore 20B. Accordingly, the fastener head 63 advances in direction R3, inward, toward the longitudinal axis and/or the interior 25 of the handguard 20. Simultaneously, the lock tab 70, and in particular, the tab head 73 moves into the barrel nut groove 43. The upper surface 73U and the tapered surfaces 73W1 and 73W2 can engage the respective surfaces 43W and/or 43B of the barrel nut groove 43. As this occurs, the tab head extends toward the longitudinal axis of the handguard and wedges into the barrel nut groove to restrain the handguard in a fixed position along and/or about the longitudinal axis.

The overall length of the fastener assembly also can increase simultaneously as the fastener head is advanced in the handguard bore converting from the retraced mode to the extended mode. For example, the overall length can increase from OL2 to OL1 contrasting FIGS. 8 and 9, as the fastener head 63 advances into the handguard bore 20B. This can occur when the second threads 62 engage the threads 72 of the lower shoulder 73S in the barrel 77 extending from the tab head 73. Due to the opposite threading of the second threads 62 relative to the first threads 61, the rotation of the fastener head 63 and shaft 64 in the first direction, optionally the clockwise CW direction, the shaft 64 threads out of the tab bore 70B and out of the barrel 77 in general. In turn, this causes the shaft end 64E to move away from the engagement wall 73EW. This also causes the lower shoulder 73S to move away from the shoulder 63S of the fastener head 63 and the fastener head in general. Further, the lock tab 70 simultaneously moves away from the fastener head as the fastener assembly transitions from the retracted mode to the extended mode. In addition, the tab head 73 and its respective surfaces also move vertically, but do not rotate, relative to the tab groove 25G such that the upper surface 73U extends above and beyond the interior surface 25S of the handguard. Thus, a portion of the lock tab 70, that is, the tab head 73 and its respective upper surface and tapered surfaces can extend into and can engage the barrel nut groove 43.

After the fastener assembly is configured in the extended mode, it can effectively restrain and/or impair the handguard 20 from rotating and/or moving longitudinally relative to the longitudinal axis and generally relative to the barrel nut. Of course, to remove the handguard from the weapon, the above steps can be reversed such that the fastener assembly disengages the barrel nut groove so the handguard can be removed from the barrel nut and thus the weapon.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A handguard assembly comprising;

a handguard defining a handguard interior, a handguard exterior, a receiver end and an opposing muzzle end, the receiver end defining a handguard bore;

a fastener assembly configured to install in the handguard bore, the fastener assembly comprising:

a fastener head including a plurality of first threads, the first threads threaded in a first direction, the first threads configured to threadably engage bore threads in the handguard bore;

a shaft joined with and extending from the fastener head, the shaft including a plurality of second threads threaded in a second direction opposite the first direction; and a lock tab including a tab head threadably engaging the plurality of second threads, whereby rotation of the fastener head advances the fastener head in the handguard bore toward the handguard interior and simultaneously advances the shaft away from the tab head.

2. The handguard assembly of claim 1, comprising:

a barrel nut disposed in the handguard interior, the barrel nut defining a barrel nut groove, wherein the tab head is configured to selectively engage the barrel nut groove of the barrel nut to secure the handguard to the barrel nut.

3. The handguard assembly of claim 1, wherein the lock tab defines a tab bore, wherein the tab bore includes a threaded tab bore portion configured to engage the plurality of second threads and an unthreaded cavity closer to the tab head than the plurality of second threads.

4. The handguard assembly of claim 3, wherein the tab bore is bounded by an engagement wall, wherein the engagement wall is opposite an upper surface of the tab head that is configured to be disposed in the barrel nut groove, wherein the shaft includes a shaft end, wherein the shaft end is configured to be distal from the engagement wall when the fastener assembly is in the extended mode.

5. The handguard assembly of claim 1, wherein the fastener head includes a drive feature that is accessible with a tool from the handguard exterior to thread the fastener head into the handguard bore, wherein the rotation of the fastener head in a first rotation direction moves the fastener head away from the tab head as the tab head moves toward the handguard interior.

6. The handguard assembly of claim 5, wherein the lock tab includes a tab barrel within which the shaft is rotatably disposed, wherein the tab barrel includes a lower shoulder, wherein the rotation of the fastener head in the first rotation direction moves the lower shoulder away from the fastener head.

7. The handguard assembly of claim 6, wherein the tab head includes an upper surface, wherein the upper surface includes a first tapered surface and a second tapered surface angled relative to one another and configured to wedge the tab head into a barrel nut groove of a barrel nut inside the handguard interior.

8. The handguard assembly of claim 1 comprising:

a helicoil disposed in the handguard bore between the handguard and the fastener assembly.

9. The handguard assembly of claim 1, wherein the tab head includes an upper surface configured to fit within the barrel nut groove, wherein an exterior of the shaft is threaded with the second threads, wherein an exterior of the fastener head is threaded with the first threads, wherein a portion of the shaft between the first threads and the second threads is void of any threads.

10. The handguard assembly of claim 1, wherein the handguard includes a handguard longitudinal axis, wherein the shaft includes a shaft axis, wherein the shaft axis extends radially toward the longitudinal axis, wherein the handguard includes a thread block that protrudes from the handguard exterior, wherein the handguard bore is defined through the thread block and projects generally toward the longitudinal axis.

11. A handguard assembly comprising:

a fastener assembly configured to install in a handguard bore of a handguard, the fastener assembly comprising:

a fastener head including a plurality of first threads, the first threads threaded in a first direction;

a shaft joined with and extending from the fastener head, the shaft including a plurality of second threads threaded in a second direction opposite the first direction; and a lock tab threadably engaging the plurality of second threads, the lock tab including a tab head.

12. The handguard assembly of claim 11, wherein rotation of the fastener head advances the fastener head in the handguard bore toward a barrel nut to secure the handguard to the barrel nut.

13. The handguard assembly of claim 12, wherein the barrel nut defines a barrel nut groove that circumferentiates a barrel nut axis, wherein the tab head includes a wedge configured to wedge into the barrel nut groove, wherein the shaft includes a shaft axis that intersects the barrel nut axis.

14. The handguard assembly of claim 11, wherein the handguard defines a handguard interior, a handguard exterior, a receiver end and an opposing muzzle end, the receiver end defining the handguard bore;

wherein the handguard bore extends radially inward toward a longitudinal axis of the handguard.

15. The handguard assembly of claim 11, wherein the lock tab defines a tab bore, wherein the tab bore includes a threaded portion configured to engage the plurality of second threads and an unthreaded cavity closer to the tab head than the plurality of second threads, wherein the tab bore is bounded by an engagement wall, wherein the engagement wall is opposite an upper surface of the tab head, wherein the shaft includes a shaft end, wherein the shaft end is configured to move away from the engagement wall as the fastener head advances toward a longitudinal axis of the handguard.

16. The handguard assembly of claim 11, comprising:

a barrel nut defining a barrel nut groove, wherein the handguard is disposed about the barrel nut to at least partially conceal the barrel nut, wherein the fastener assembly is operable in a retracted mode and an extended mode, wherein in the retracted mode, the lock tab is adjacent the barrel nut groove but the hand guard can move relative to the barrel nut, wherein in the extended mode, the lock tab is extended toward the longitudinal axis, and projects into and engages the barrel nut groove to restrain the handguard in a fixed position along the longitudinal axis and about the longitudinal axis.

17. The handguard assembly of claim 16, wherein the fastener assembly moves toward the longitudinal axis and the lock tab simultaneously moves toward the fastener head when the fastener assembly transitions from the retracted mode to the extended mode.

18. A method of using a handguard assembly, the method comprising:

installing a fastener assembly in a handguard bore of a handguard, the fastener assembly comprising a fastener head including a plurality of first threads, the first threads threaded in a first direction, a shaft joined with and extending from the fastener head, the shaft including a plurality of second threads threaded in a second direction opposite the first direction, and a lock tab threadably engaging the plurality of second threads, the lock tab including a tab head.

19. The method of claim 18 comprising:

disposing the handguard about a barrel nut to at least partially conceal the barrel nut, aligning the tab head with a barrel nut groove defined by the barrel nut;

rotating the fastener assembly so that the tab head extends toward a longitudinal axis of the handguard, and wedges into the barrel nut groove to restrain the handguard in a fixed position.

20. The method of claim 19 comprising:

rotating the fastener assembly so that the second threads thread out of a tab lock threaded portion such that an overall length of the fastener assembly increases as the tab head engages a barrel nut groove defined by a barrel nut.

* * * * *